US006352128B1

(12) United States Patent
Püttmann

(10) Patent No.: US 6,352,128 B1
(45) Date of Patent: Mar. 5, 2002

(54) STEERED-HEAD RAM DRILLING TOOL

(75) Inventor: Franz-Josef Püttmann, Lennestadt (DE)

(73) Assignee: Tracto-Technik Paul Schmidt Spezialmaschinen, Lennestadt (DE)

( * ) Notice: Subject to any disclaimer, the term of this patent is extended or adjusted under 35 U.S.C. 154(b) by 0 days.

(21) Appl. No.: 09/469,845

(22) Filed: Dec. 21, 1999

(30) Foreign Application Priority Data

Dec. 22, 1998 (DE) ..... 198 59 367

(51) Int. Cl.[7] ..... E21B 7/04
(52) U.S. Cl. ..... 175/19; 145/73
(58) Field of Search ..... 175/19, 61, 73, 175/75

(56) References Cited

U.S. PATENT DOCUMENTS

| | | | | |
|---|---|---|---|---|
| 5,322,391 A | | 6/1994 | Fisk | 175/73 |
| 5,350,254 A | | 9/1994 | Fisk et al. | 405/184 |
| 5,597,046 A | | 1/1997 | Fisk | 175/67 |
| 6,082,453 A | * | 7/2000 | Bakke | 175/73 |

FOREIGN PATENT DOCUMENTS

| | | | |
|---|---|---|---|
| DE | 2524210 | * 12/1976 | 175/19 |
| DE | 196 50 271 | 6/1998 | |
| EP | 0 301 287 | 2/1989 | |
| WO | 94/05941 | 3/1994 | |

* cited by examiner

*Primary Examiner*—William Neuder

(57) ABSTRACT

In a ram drilling tool having a steering element, for example a steering head, which is mounted in the tool casing such that it can move, for example rotate, the tool casing is connected to a pressure-medium line such that it cannot rotate and to a sleeve pipe such that it can rotate; it may therefore be adjusted with low friction by means of rotation with the aid of the pressure-medium line with respect to the steering element, which is firmly held by the ground.

13 Claims, 4 Drawing Sheets

STEERED-HEAD RAM DRILLING TOOL

Figure 1:
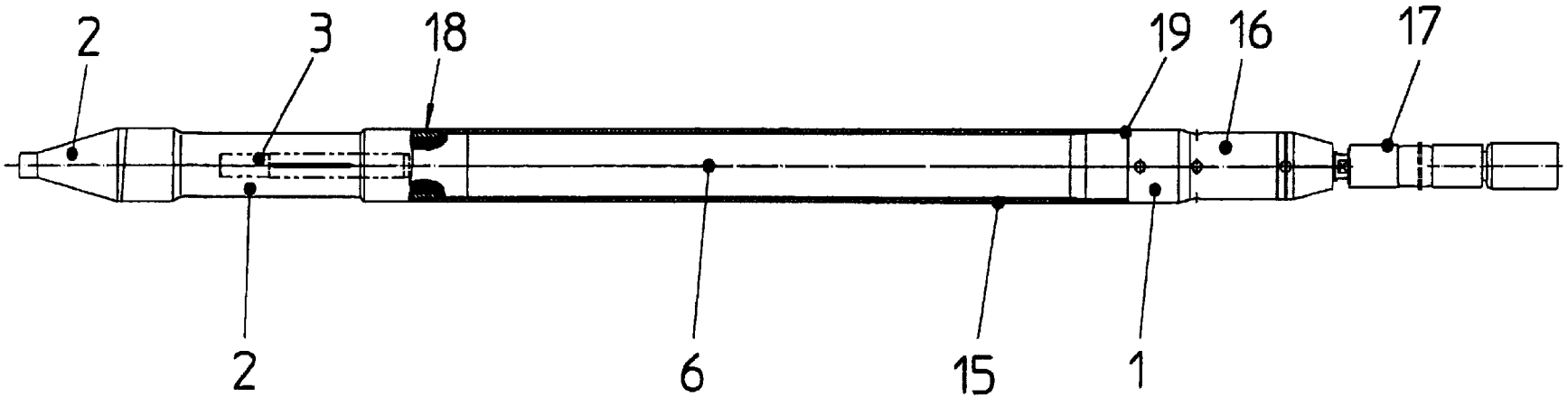

The invention relates to a ram drilling tool for producing underground bores or for laying lines in the ground, for example at the same time as the production of a new underground bore or the widening of one which already exists.

Tools of this type are normally equipped for boring in a straight line or in curves, and then have an adjustable steering or boring head, for example one which can be rotated about its longitudinal axis in relation to the tool casing, whose angular position in relation to the tool casing determines the direction of motion of the tool.

The manner in which the relative position of the steering head and tool casing is adjusted, and how traveling on a curve is effected, can be very different. Examples of steerable ram drilling tools are found in U.S. Pat. Nos. 5,322,391, 5,350,254, 5,597,046, European patent 0 301 287 and in PCT published specification WO 94/05941, whose content is referred to expressly here.

In the tool according to the PCT published specification, the steering head is designed as a sphere, for example, and is mounted in the tool casing such that it can rotate; its axis of rotation extends at an angle in relation to the casing longitudinal axis. At the same time, the contact faces of the steering head and casing, which extend at right angles to the axis of rotation and are in contact with each other, likewise extend at an angle in relation to the casing longitudinal axis. This makes it possible to rotate the tool casing about its longitudinal axis while the ground holds the steering head firmly. As a result of such a rotation of the casing, the steering head can be moved into an eccentric position with respect to the tool casing, in which position travel on a curve takes place. The rotational angle between the steering head and the tool casing or, respectively, the two end positions of the steering head, are determined by a driver pin which is connected to the steering head and engages in a circular slot in the tool casing. If the pin rests on one end of the tool slot, then the steering head is in its position for traveling straight ahead (straight-ahead position), while, at the other end of the tool slot, it is located in the position for traveling on a curve (steering position). In this case, the tool is configured in such a way that the steering head is subject to a tendency always to move into one of the two working positions.

In order to bring the ram drilling tool from straight-ahead travel onto a specific curved path, the tool casing must be rotated with the aid of the compressed-air hose until the tool has reached the required angular position (initial position) for the desired curved path.

This rotational movement may be composed of two phases. In this case, the first phase consists firstly in only the tool casing being rotated until the driver pin has passed from the straight-ahead position into the steering position over the entire differential angle. As soon as this has taken place, the steering head and the tool casing are coupled to each other for the further rotational movement, that is to say the tool casing and the steering head rotate together until the initial position for traveling on a curve has been reached.

If, on the other hand, the driver pin is in its steering position from the start, then common rotation of the tool casing and of the steering head entails the simultaneous rotation of the hose. This case arises, for example, when the steering head unintentionally gets into the steering position during straight-ahead boring, and therefore a corrective movement of the tool casing is necessary, or when a correction to the direction is necessary while traveling on a curve.

Irrespective of the initial position for changing the direction of boring in the individual concrete case, in any case a change of direction requires rotation of the tool casing about its longitudinal axis, with the steering head stationary.

Such a rotation is possible only with the aid of the compressed-air hose connected to the rear end of the tool. However, this is associated with considerable problems, since the compressed-air hose must not be flexurally rigid and therefore cannot be torsionally rigid either. To this is added the fact that when the ram drilling tool is rotated—even with the aid of a pipe linkage for the pressure-medium supply—the ground friction acting on its casing has to be overcome. This friction can be very considerable—depending on the condition of the ground and on the external diameter and the length of the tool—so that during extended boring or in the case of rotation on a correspondingly long pressure-medium line (compressed-air hose) it is often even no longer possible to rotate the casing in the ground or to apply the forces necessary for this.

The friction between the casing and ground may certainly be avoided if the front part of the tool has a greater diameter than the rest of the casing. However, this breaks down because the friction between the casing and ground is imperative, in order that the ground can absorb the reaction forces directed counter to the boring direction.

In the case of the known tools with a compressed-air hose, a further disadvantage consists in the fact that because of the torsion of the compressed-air hose it is not possible to determine from outside the underground bore, at least not with the necessary accuracy, when the ram drilling tool begins to rotate, by which angle it actually rotates and at which angle the rotation has been completed.

However, since accurate boring is only possible when the steering head or an adjustable steering element assumes a predefined angular position in relation to the casing of the ram drilling tool, in practice it is critical in each case that the tool casing is rotated only for so long and to such an extent that the predefined steering angle is reached.

The invention is therefore based on the problem of providing a ram drilling tool having a steering head or steering element which is mounted such that it can rotate in the tool casing, said steering head or steering element permitting the most accurate possible rotation of the casing through a specific angular range or even by more than one complete revolution.

This problem finds its solution in a ram drilling tool having a steering element, for example a steering head, which is mounted in the tool casing such that it can move, for example rotate, and having a pressure-medium line, for example a compressed-air hose, which is connected to the tool casing such that it cannot rotate and whose casing is connected to a sleeve pipe such that it can rotate. The sleeve pipe is preferably connected to the tool casing such that it cannot be displaced axially.

This makes it possible to rotate the tool casing in relation to the steering element and the sleeve pipe with more or less ground friction, while the steering element is held firmly by the surrounding ground or with the aid of the sleeve pipe. The amount of ground friction which has to be overcome in the individual case essentially depends on the length of the sleeve pipe; the ground friction reduces with increasing length of the sleeve pipe and is dispensed with if the sleeve pipe extends from the steering element as far as the rear end of the casing.

In order to keep the friction low, a rotary bearing can be arranged between the sleeve pipe and the tool casing, preferably in the area of the steering element. A further rotary bearing can be located at the rear end of the tool.

Such a rotary bearing can comprise an inner ring in the sleeve pipe, for example having a rectangular cross section, engaging in a complementary recess in the tool casing. In this case, the inner ring can rest on one side on a shoulder on the tool casing and on the other side on the steering head or a transmitter casing which is arranged between the steering head and the tool casing but is connected to the tool casing such that it cannot rotate.

A further reduction in the frictional forces results if the free space between the sleeve pipe and the tool casing is sealed off from the outside, and therefore no soil can penetrate. Here, the free space can also be filled with a lubricant, for example with grease or oil.

In order to avoid inadvertent rotation of the casing in relation to the steering element, a releasable locking mechanism can be arranged between the sleeve pipe and the tool casing.

In any case, the sleeve pipe absorbs at least some of the ground friction and in this way ensures that the ram drilling tool can move forward in the ground under the influence of the percussion energy transferred to the casing from the percussion piston, which is moved to and fro pneumatically or hydraulically, and that, at the same time, rotation of the tool casing in relation to the steering head is possible without (excessively high) ground friction.

Figure 2:
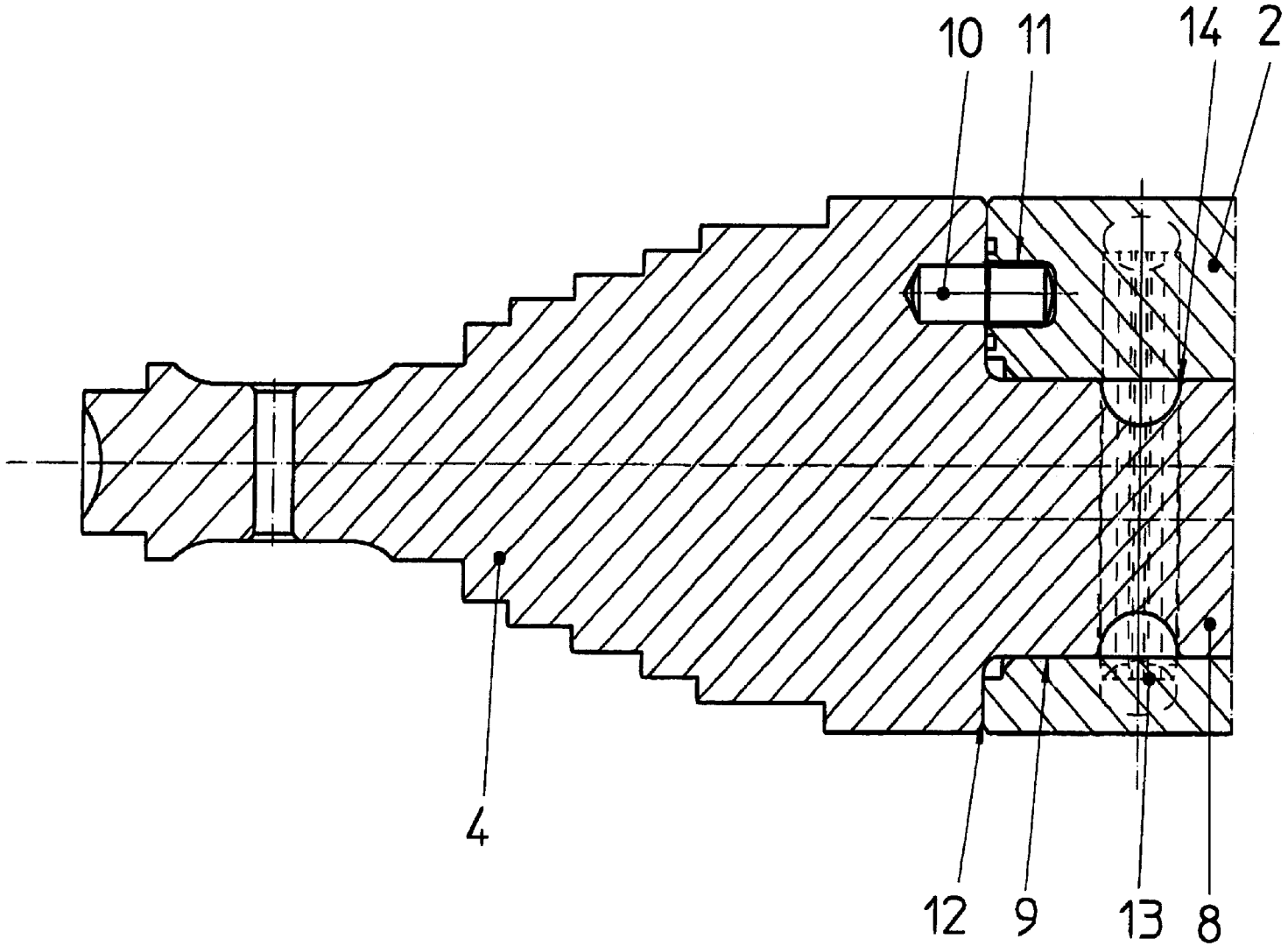
Figure 3:
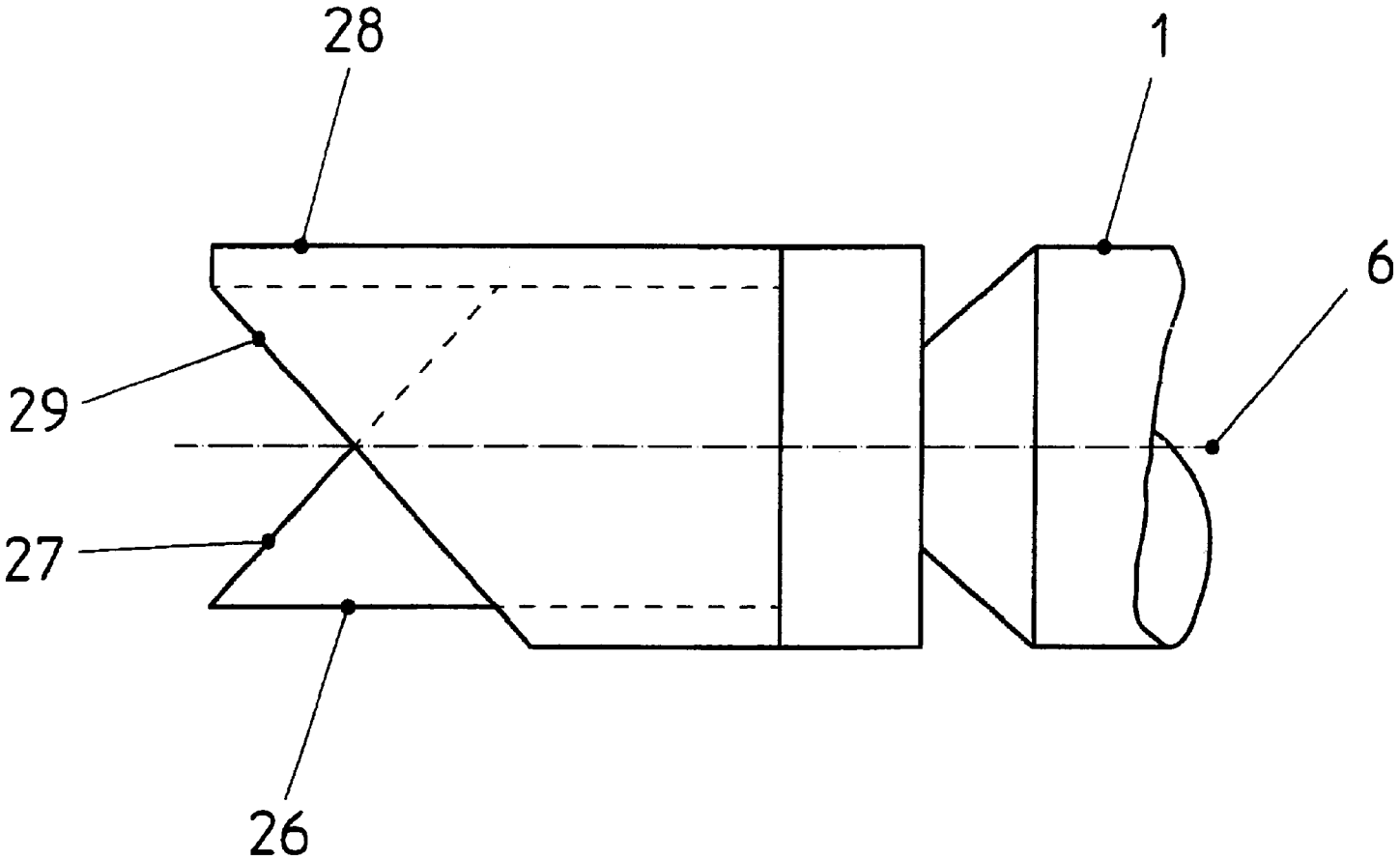
Figure 4:
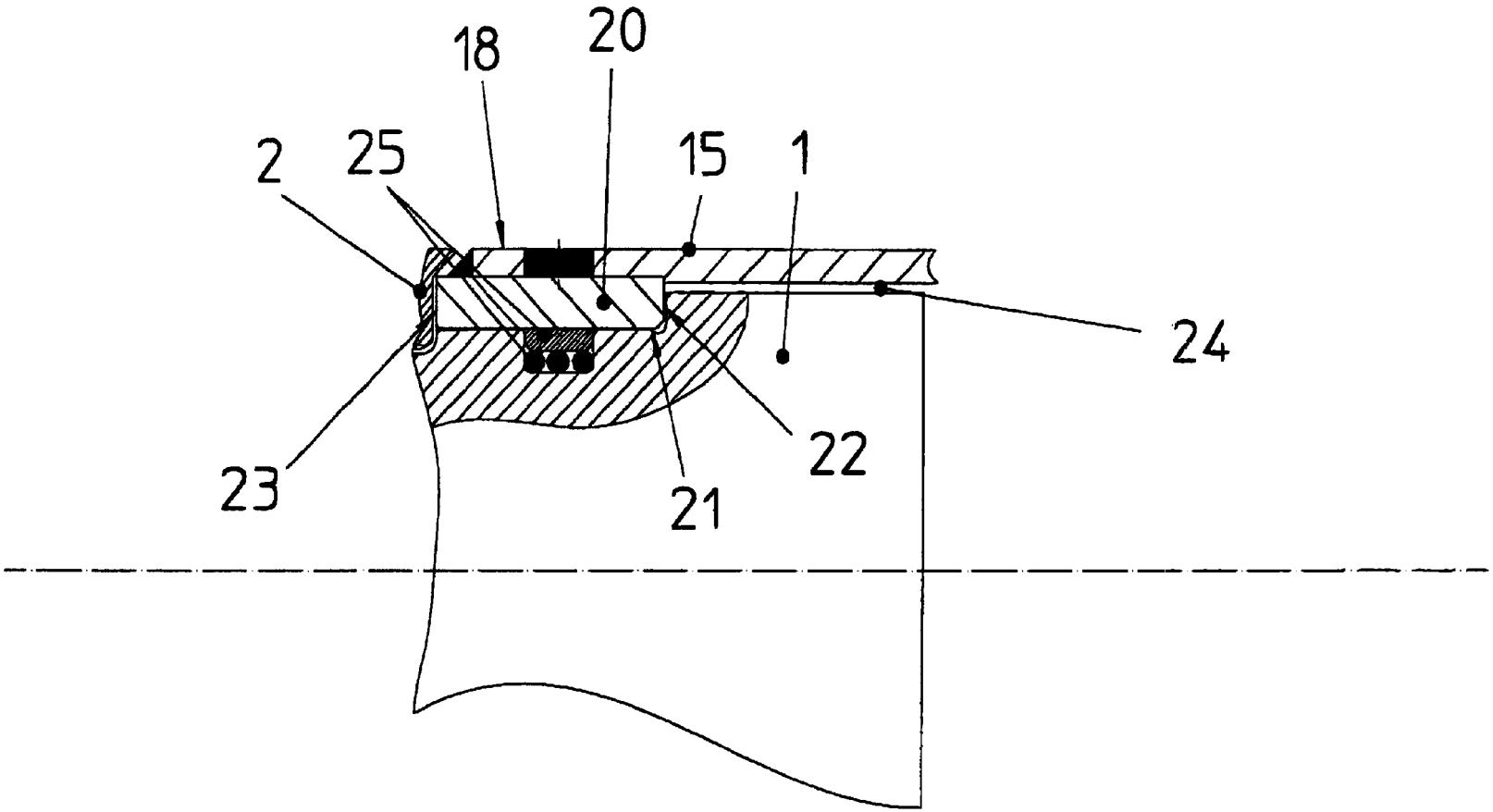

The invention will be explained in more detail below using an exemplary embodiment illustrated in the drawing, in which:

FIG. 1 shows a ram drilling tool having a steering head and an adjoining transmitter casing, FIG. 2 shows a steering element, FIG. 3 shows a further steering element and FIG. 4 shows an enlarged illustration of a detail from FIG. 1 with a rotary bearing between a sleeve pipe and the tool casing.

In its general composition and mode of operation, the ram drilling tool corresponds to the tool described in the German laid-open specification 196 50 271; it comprises a casing 1, in whose front part 2 a transmitter 3 is arranged, and a steering head 4. The steering head 4 is mounted such that it can rotate in the tool casing, which is designed as a transmitter casing 2, as illustrated and described in the PCT published specification WO 94/05941. For example, the steering head 4 may have an axis of rotation 5 which extends at an angle to the longitudinal axis 6 of the tool casing 1 and at the same time at right angles to the plane of contact 7 between the steering head 4 and transmitter casing 2.

Another possibility is for the steering head 4, as illustrated in FIG. 2, to be mounted eccentrically, by means of a rotary journal 8, in a bore 9 in the transmitter casing 2. In this case, the steering head 4 has a driver pin 10 which engages in a circularly curved slot 11 in the end face 12 of the transmitter casing 2. The rotary journal 8 is secured against longitudinal movement in the transmitter casing 2 with the aid of clamping pins 13, which engage in recesses 14 in the rotary journal.

Finally, the tool casing 1 can also be connected such that it cannot rotate to a cylindrical core 26, which is provided with a front inclined face 27 and is mounted, via a rotary bearing (not illustrated), in an enveloping body 28, likewise having a front inclined face 29. If the two inclined faces 27, 29 face each other, as illustrated in FIG. 3, the tool moves in a straight line. Following a rotation of the casing 1 through 180°, the inclined faces 27, 29 are located in a plane, so that the tool moves on a curved path, which is curved in the direction facing away from the inclined face. Rotating only the steering element in this way is possible, because the enveloping body is held firmly in the ground with a frictional and positive fit.

The transmitter casing 2 can be connected to the tool casing such that it cannot rotate or can be designed in one piece with it.

The tool casing, with the exception of the transmitter casing 2, is surrounded by a sleeve pipe 15, which extends as far as the rear part of the tool casing 1, so that of the casing, only the transmitter casing 2 and the rear end 16 having the compressed-air hose 17 connected to the casing 1 such that it cannot rotate are not surrounded by the sleeve pipe 15.

Between the sleeve pipe 15 and the tool casing, in the area of the front and rear ends of the sleeve pipe, in each case there is located a rotary bearing 18, 19. The rotary bearing 18 comprises an inner ring 20 of rectangular cross section which is permanently connected to the sleeve pipe 15. This inner ring engages in a step 21 on the tool casing 1 and at the same time extends between a shoulder 22 on the casing and a stop face 23 on the front transmitter casing 2. In order to prevent the penetration of dirt into the free space 24 between the tool casing 1 and the sleeve pipe 15, the rotary bearing 18 is provided with a seal 25.

The rear rotary bearing 19 is composed in the same way as the front rotary bearing 18.

Since in the case of the ram drilling tool illustrated only the front part 2 (transmitter casing) comes into contact with the ground partially, that is to say in the area of its thickening, and the rear end of the casing, which is partly of smaller diameter, comes into contact with the ground, rotation of the casing in relation to the steering head is possible with the aid of the compressed-air hose 17 without excessively high frictional resistance.

What is claimed is:

1. A ram drilling tool for producing underground bores having a steering element mounted in a tool casing, the tool casing being rotationally fixedly connected to a pressure-medium line, and a sleeve pipe rotationally connected to the tool casing, wherein the tool casing rotates within the sleeve pipe.

2. The ram drilling tool as claimed in claim 1, wherein the steering element is mounted such that it can rotate.

3. The ram drilling tool as claimed in claim 1, wherein the sleeve pipe is connected to the tool casing such that it cannot be displaced axially.

4. The ram drilling tool as claimed in claim 1, wherein the sleeve pipe extends as far as a rear end of the tool casing.

5. The ram drilling tool as claimed in claim 1, wherein the sleeve pipe and the tool casing are rotationally connected via a rotary bearing arranged at a front end of the tool casing.

6. The ram drilling tool as claimed in claim 1, wherein a rotary bearing is arranged at a rear end of the tool casing, between the sleeve pipe and the tool casing.

7. The ram drilling tool as claimed in claim 1, wherein an inner ring in the sleeve pipe engages in a recess in the tool casing.

8. The ram drilling tool as claimed in claim 1, wherein a free space between the sleeve pipe and the tool casing is sealed off from the outside.

9. The ram drilling tool as claimed in claim 1, wherein a free space is filled with a lubricant.

10. The ram drilling tool as claimed claim 1, wherein a locking mechanism is arranged between the sleeve pipe and the tool casing.

11. The ram drilling tool as claimed in claim 1, wherein the tool casing projects beyond the sleeve pipe, and outside the sleeve pipe has a smaller diameter than the sleeve pipe along at least a portion thereof.

12. The ram drilling tool as claimed in claim 1, wherein a steering head which tapers toward a front thereof is rotationally mounted in the tool casing and has an axis of rotation which extends at an angle to a tool casing longitudinal axis.

13. The ram drilling tool as claimed in claim 1, wherein the steering element is provided with an inclined face in the form of an enveloping body having a concentric core which has another inclined face connected to the tool casing, and having a rotary bearing between the concentric core and the enveloping body.

* * * * *